United States Patent [19]

Jecko et al.

[11] Patent Number: 4,638,271

[45] Date of Patent: Jan. 20, 1987

[54] METHOD OF INCREMENTALLY ADJUSTING THE CENTER FREQUENCY OF A MICROSTRIP-LINE PRINTED FILTER BY MANUEVERING DIELECTRIC LAYERS

[75] Inventors: Jean-René Jecko, Talence; Marcel Motola, Paris, both of France

[73] Assignee: Thomson-CSF, Paris, France

[21] Appl. No.: 614,083

[22] Filed: May 25, 1984

[30] Foreign Application Priority Data

May 31, 1983 [FR] France ..... 83 09008

[51] Int. Cl.[4] ..... H01P 1/203

[52] U.S. Cl. ..... 333/205; 333/235

[58] Field of Search ..... 333/202–205, 333/219–221, 235, 246

[56] References Cited

U.S. PATENT DOCUMENTS

| | | | |
|---|---|---|---|
| 3,617,955 | 11/1971 | Masland | 333/204 |
| 4,157,517 | 6/1979 | Kneisel et al. | 333/205 |
| 4,218,664 | 8/1980 | Assal et al. | 333/203 X |
| 4,243,960 | 1/1981 | White et al. | 333/196 |
| 4,288,530 | 9/1981 | Bedard et al. | 333/205 X |
| 4,488,131 | 12/1984 | Griffin et al. | 333/205 |

FOREIGN PATENT DOCUMENTS

| | | | |
|---|---|---|---|
| 1228011 | 11/1966 | Fed. Rep. of Germany . | |
| 2016881 | 5/1970 | France . | |
| 2070656 | 9/1971 | France . | |
| 2494917 | 5/1982 | France . | |
| 1422803 | 1/1976 | United Kingdom | 333/204 |

OTHER PUBLICATIONS

IEEE Transactions on Microwave Theory and Techniques, vol. MTT-26, No. 9, Sep. 1978 (New York, US) D. Paolino, "MIC Overlay Coupler Design Using Spectral Domain Techniques," pp. 646–649.

*Primary Examiner*—Eugene R. LaRoche
*Assistant Examiner*—Benny T. Lee
*Attorney, Agent, or Firm*—Pollock, VandeSande & Priddy

[57] ABSTRACT

A method is provided for adjusting the electrical characteristics and particularly the frequency of a microstrip-line printed filter with distributed constants. The method consists in depositing a strip of dielectric material on all the microstrip resonators of the filter.

3 Claims, 6 Drawing Figures

PRIOR ART FIG_1
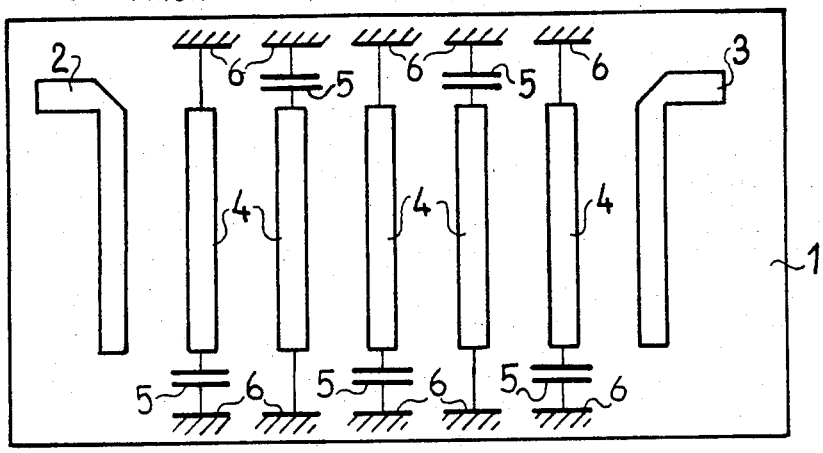
FIG_2-a
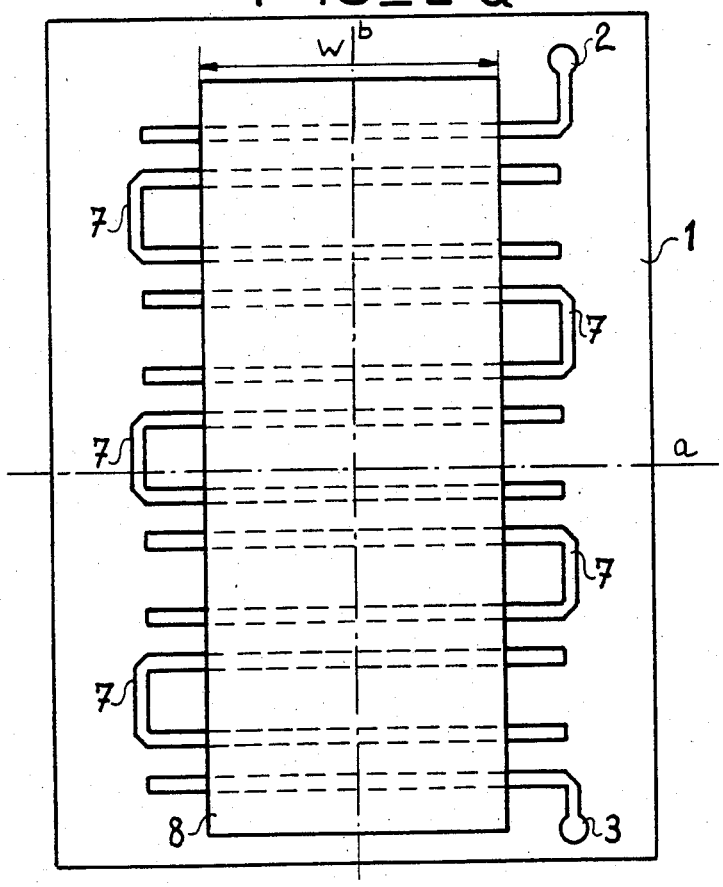

FIG_2-b
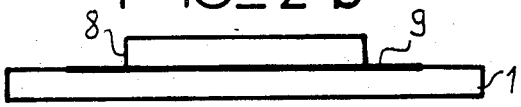
FIG_2-c
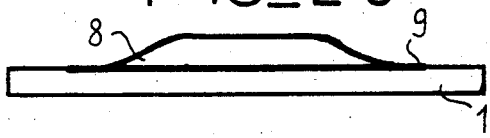
FIG_3
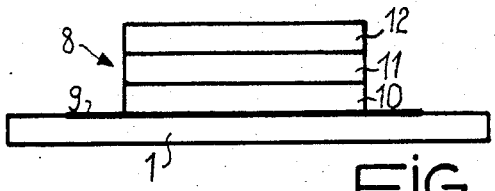
FIG_4
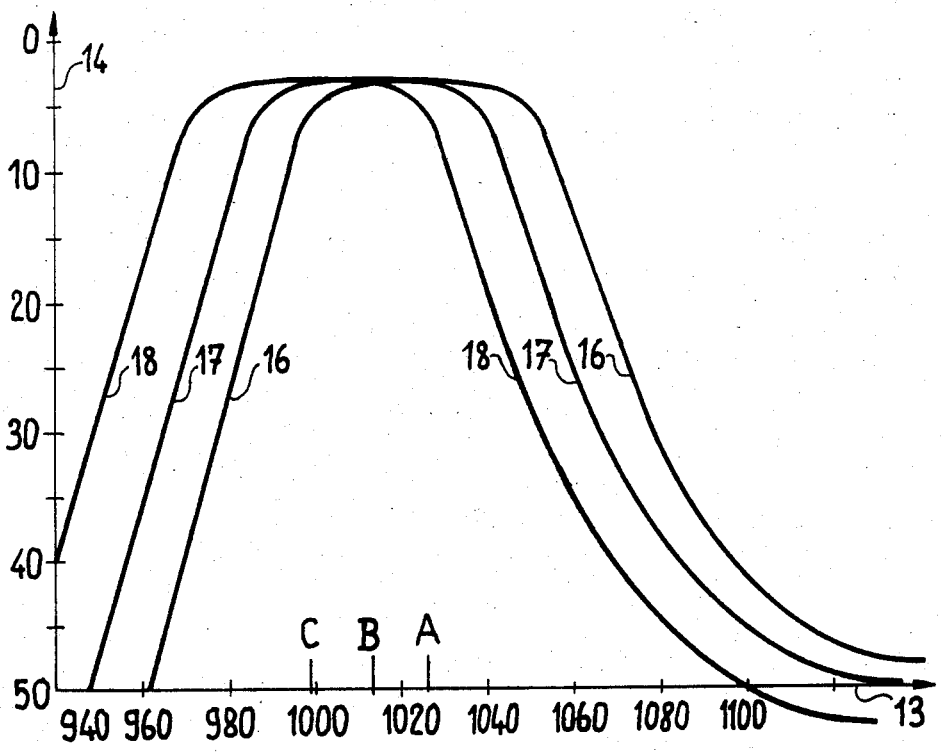

METHOD OF INCREMENTALLY ADJUSTING THE CENTER FREQUENCY OF A MICROSTRIP-LINE PRINTED FILTER BY MANUEVERING DIELECTRIC LAYERS

BACKGROUND OF THE INVENTION

1. Field of the Invention

The present invention relates to filters consisting of distributed-constant elements such as filters printed in microstrip lines.

The invention is more particularly concerned with a method of adjustment and particularly frequency adjustment of a microstrip-line printed filter and also relates to the filter which is obtained by means of this method.

2. Description of the Prior Art

Filters of this type, one example of which is illustrated in FIG. 1, comprise a dielectric substrate on which metallizations have been formed by etching, for example. These metallizations can have different shapes.

The possibility of frequency adjustment of filters of this type is considered as an important requirement.

Frequency adjustment of these filters is already known and is performed in a number of different ways. A first method consists in varying the length of the microstrips, for example by cutting part of these microstrips with a scalpel. This mode of adjustment of a filter is subject to the major disadvantage of being irreversible. This is particularly serious in the event that the desired adjustment value has been overstepped. Furthermore, by cutting part of these microstrips with a scalpel, there is a potential danger of causing damage to the substrate on which they are deposited, which is liable to give rise to an immediate variation of its electrical characteristics and to chemical degradation in the long term. Another mode of frequency adjustment of microstrip-line printed filters as illustrated in FIG. 1 consists in soldering capacitors to the ends of the strips. The method in accordance with the present invention permits filter adjustment and does not give rise to the disadvantages mentioned in the foregoing.

SUMMARY OF THE INVENTION

The invention is primarily directed to a method for adjusting the electrical characteristics of a distributed-constant filter and is distinguished by the fact that this method consists in depositing at least one dielectric material having a given geometry.

BRIEF DESCRIPTION OF THE DRAWINGS

Other features of the invention will be more apparent upon consideration of the following description and accompanying drawings, wherein:

FIG. 1 is a top view of a distributed-constant filter equipped with a frequency adjustment device of a known type;

FIG. 2 is a sectional top view of a distributed-constant filter comprising an adjustment device in accordance with the invention;

FIG. 3 is a view of another embodiment of the frequency adjustment device in accordance with the invention;

FIG. 4 is an explanatory diagram.

In FIGS. 1 to 4, the same references designate the same elements.

In FIG. 1, there is shown a distributed-constant filter having an alternate interlocking-finger structure and known as an interdigital filter. This filter comprises microstrips 2, 3 and 4 etched in a dielectric substrate 1. The microstrips 2 and 3 constitute respectively the electrical input and output of the filter. The microstrips 4 constitute resonators which permit filtering. The ends of the microstrips 4 are connected to ground 6. The filter illustrated in FIG. 1 is a bandpass filter. It may prove advantageous to adjust the center frequency of a filter of this type. This adjustment may be made necessary by manufacturing tolerances, for example a variation in dielectric constant of the substrate 1 or a variation in its thickness. Variations in the center frequency of the filter may also result from etching of the microstrips 2, 3 and 4. In order to restore the center frequency f to a desired value $f_o$, capacitors 5 are soldered to the ends of the microstrips 4. These capacitors 5 are placed between the ends of the microstrips 4 and ground 6. This permits frequency adjustment of the filter.

This type of adjustment is subject to many disadvantages. In the first place, it is a difficult and time-consuming operation by reason of the large number of capacitors 5. Secondly, the hybrid technology comprising distributed constants and localized constants gives rise to problems of matching. Lastly, the reliability of the filter is reduced as a result of soldering of the capacitor 5.

DESCRIPTION OF THE PREFERRED EMBODIMENTS

In FIG. 2, there is shown one example of a bandpass filter in accordance with the invention. The filter is of the hairpin type, so-called because it comprises signal-propagating microstrip resonators 7 each having a U-shaped which resembles that of a hairpin. The L-shaped microstrips 2 and 3 constitute respectively the electrical input and output of the filter. A dielectric element 8 is placed of the microstrips. The presence of an element 8 has the effect of modifying the behavior of the filter.

The invention proposes to make use of these modifications in the behavior of the filter for the purpose of carrying out an adjustment either in order to modify the behavior of the filter during its utilization or else in order to adjust a filter, for example to a predetermined center frequency with a view to overcoming the problem of dispersion of center frequencies arising from excessive manufacturing tolerances. These manufacturing tolerances result in particular from the variation in dielectric properties of the substrate 1 on which the microstrips are etched. The element 8 is advantageously constituted by a low-loss dielectric such as, for example, PTFE (polytetrafluoroethylene). The element 8 preferably has a constant thickness. It is also an advantage to ensure that the element 8 has a constant width over all the resonators 2, 3 and 7 which are covered. In the remainder of this specification, the microstrips constituting the resonators 2, 3, 4 and 7 will be designated by the reference numeral 9.

In an alternative embodiment illustrated in FIG. 2*b*, the element 8 is a strip having the shape of a rectangular parallelepiped. In another alternative embodiment illustrated in FIG. 2*c*, the width of the dielectric element 8 decreases as the distance from the ends of the microstrips 9 increases. This geometry of the element 8 minimizes mismatch of wave propagation arising from the air-dielectric transition. It is an advantage to place the strip 8 at right angles to the resonators of the filter and also to deposit the strip 8 on all the filter resonators. The strip 8 is preferably deposited in such a manner as to maintain symmetry of distribution of the field lines of the filter. In FIG. 2, this has been achieved by placing the major (b) and minor (a) axes of symmetry of the filter to be aligned with the corresponding axes of symmetry of the strip 8 which covers all the resonators 7. This facilitates advance estimation of the influence of the strip 8 on the behavior of the filter. Thus the frequency shift of the filtering curve takes place without any change in its shape. The filter shown in FIG. 2*a* is a bandpass filter having a narrow pass band.

The invention is particularly advantageous in the case of filters of this type which have, for example, a ratio of the 3-dB pass band to the center frequency which is lower than 0.1. The values of the adjustment are in fact limited by the dielectric materials presently available. When using filters of this type, it is possible to obtain a frequency shift of the filtering curve without resulting in any change of shape of the curve.

The form of construction of the filter which now follows is given solely by way of example.

The filter is fabricated from a substrate 1 of ceramic-filled PTFE as marketed by the Rogers Company under the trademark Duroid 6010. The dielectric constant is $10.5 \pm 0.25$ and the thickness is $1.27 \pm 0.05$ mm. The substrate is provided on both faces with a copper deposit having a thickness of 35 $\mu$m. Etching of the microstrips is performed on one of these deposits while the other deposit constitutes the ground of the filter. The filter of FIG. 2 has a center frequency of 1000 MHz and a pass band, in the case of 3-dB attenuation, of 50 MHz. The filter is advantageously provided with a cover of stainless steel, for example. By means of the cover, the field lines which are not captive in the dielectric substrate can be closed on ground. By way of example, the cover provides a 3 mm space above the filter pattern. The cover permits improved out-of-band frequency rejection while having a negligible influence on the position of the center frequency. Advantageously, said space is filled with the strip 8. Adjustment of the filter is carried out by selecting the width W of the strip 8. The strip consists of a low-loss dielectric such as, for example, the PTFE products marketed by Dupont de Nemours under the trademark Teflon TFE 5 having a dielectric constant in the vicinity of 2. Referring to FIG. 2*b*, the adjustment is performed either by reducing the width of the strip 8, for example by making cuts with a scalpel 20 until the desired value is obtained or by making provision for a set of cut strip sections 8*a*, 8*b*, etc., having different widths. The strip 8 including a number of sections of cumulative desired width is initially placed on the filter to be adjusted. The adjustment to be performed is reversible since it is only necessary to incrementally remove a strip section at a time; and in the event of overstepping of the value of the desired center frequency, it is merely necessary to replace a strip section without touching the filter resonators.

There is shown in FIG. 3 an alternative form of construction of a filter in accordance with the invention. In the device of FIG. 3, the frequency shift is obtained by placing on the microstrips 9 a strip 8 of fixed length, the thickness of which is caused to vary either by machining or by stacking a predetermined number of elementary dielectric wafers 10, 11, 12. In an alternative embodiment, the wafers 10, 11, 12 do not have the same dielectric constant. In this case the adjustment is performed not only by means of the thickness and number of wafers but also by means of their arrangement in the stack. The influence of the dielectric wafers 10, 11, 12 is related to the distance between these wafers and the microstrips. Thus the fact of placing wafers having a high dielectric constant close to the microstrips 9 increases the value of the corrections made by the adjustment.

FIG. 4 illustrates the result of the adjustments obtained by means of the device of FIG. 2. The frequencies in MHz have been plotted along abscissa 13. The insertion losses in decibels have been plotted along ordinate 14. Curve 16 represents the insertion losses as a function of the frequency of the filter without the strip 8. The center frequency (A) of the filter equipped with its cover is 1025 MHz. Curve 17 represents the insertion losses as a function of the frequency of the filter equipped with a PTFE strip having a width of one centimeter. In this case the center frequency (B) of the filter is 1013 MHz. Curve 18 represents the insertion losses as a function of the frequency of a filter equipped with a PTFE strip having a width of 2 cm. In this case the center frequency (C) of the filter is 999 MHz. In the case of the small corrections illustrated in this example, the center frequency shift is proportional to the width of the strip with a sensitivity of 13 MHz per centimeter in the example illustrated. In this example, adjustment of the center frequency is possible up to at least 3%. This guards against the effects of variations in manufacture which arise mainly from the substrate and are such that their influence on the center frequency of the filter (for example in the case of Duroid 6010) is of the order of $\pm 1.5\%$.

What is claimed is:

1. A method for fabricating a printed circuit filter having a reversibly adjustable center frequency, the method comprising the steps:

forming a plurality of microstrip resonators in generally parallel relationship on a substrate;

depositing a main dielectric material strip lengthwise along the substrate and generally perpendicularly across the parallel resonators to achieve an initial filter center frequency;

incrementally maneuvering dielectric strip sections to and from the main dielectric strip to effect incremental center frequency shifts of the filter.

2. A method for fabricating a printed circuit filter having a reversibly adjustable center frequency, the method comprising the steps:

forming a plurality of microstrip resonators in generally parallel relationship on a substrate;

depositing a stack of aligned individual layers of dielectric material lengthwise along the substrate and generally perpendicularly across the parallel resonators to achieve an initial filter center frequency;

incrementally maneuvering individual ones of the dielectric layers to and from the stack corresponding to incremental center frequency shifts of the filter.

3. The method set forth in claim 2 wherein the individual layers of dielectric material have different dielectric constants, the maneuvering of individual layers resulting in a corresponding incremental change in the center frequency of the filter dependent upon the dielectric constant of the maneuvered layer.

* * * * *